United States Patent [19]

Rodriguez-Martinez

[11] 4,011,152

[45] Mar. 8, 1977

[54] SYSTEM FOR AUTOCONTROLLING AND REGULATING THE AVERAGE VALUE OF THE VOLTAGE APPLIED TO PROCESSES FOR THE ELECTROLYTIC COLORING OF ANODIZED ALUMINUM

[75] Inventor: Dionisio Rodriguez-Martinez, Alicante, Spain

[73] Assignee: Empresa Nacional del Aluminio, S.A., Alicante, Spain

[22] Filed: Oct. 6, 1975

[21] Appl. No.: 620,538

[30] Foreign Application Priority Data

Mar. 12, 1975 Spain ..... 437604

[52] U.S. Cl. ..... 204/228; 204/DIG. 9

[51] Int. Cl.[2] ..... C25D 9/06

[58] Field of Search ..... 204/228, DIG. 9, 58

[56] References Cited

UNITED STATES PATENTS

| | | | |
|---|---|---|---|
| 2,951,025 | 8/1960 | Mostovych | 204/228 |
| 3,418,222 | 12/1968 | Schaedel | 204/228 |
| 3,597,339 | 8/1971 | Newman et al. | 204/228 |
| 3,622,804 | 11/1971 | Mitchell | 204/228 |

*Primary Examiner*—T. M. Tufariello
*Attorney, Agent, or Firm*—Ladas, Parry, Von Gehr, Goldsmith & Deschamps

[57] ABSTRACT

Apparatus for electrolytically coloring anodized aluminum comprises a power transformer whose secondary winding has one phase connected directly to the charge and its other phase connected to the charge through two anti-parallel thyristors. One of the thyristors is triggered in accordance with a predetermined program, and the other thyristor is triggered in dependence upon unbalance in the average values of the voltages applied to the charge in consecutive half cycles of the alternating current applied to the charge, in such a manner as to tend to eliminate the unbalance.

3 Claims, 5 Drawing Figures

SYSTEM FOR AUTOCONTROLLING AND REGULATING THE AVERAGE VALUE OF THE VOLTAGE APPLIED TO PROCESSES FOR THE ELECTROLYTIC COLORING OF ANODIZED ALUMINUM

The present invention refers to a system for autocontrolling and regulating the average value of the voltage which should be applied to processes for the electrolytic colouring of anodized aluminium.

Using symmetrical alternating current, since this is applied to an anodic film, an unbalance is produced between the deposition semi-cycle and the depolarization semi-cycle, the average voltage being higher in the positive phase with respect to the aluminium. This unbalance is due to the filtering effect of the anodic film which has the characteristics of a semi-conductor.

This filtering effect varies during the colouring process, on account of the modification of the characteristics of the anodic film itself due to the deposition produced therein, which variation always exists irrespective of the electrolyte used.

The unbalance ratio depends on the electrolyte of the colouring bath, i.e. on its conductivity, its pH, its composition, etc., as well as on the characteristics of the anodic film, which characteristics, in turn, depend on the physico-chemical conditions of the anodized process, composition, conductivity, applied voltage, temperature, etc.

The greater the previously mentioned unbalance ratio, the larger the surface to be coloured, the higher the applied voltage and the lower the pH.

On the other hand, the greater this unbalance ratio, the poorer the penetration in the deposition and the lesser the fixing of the pigment. Likewise, it would be desirable to operate at a low pH in order to obtain a higher conductivity and a better penetration but, as has been said, the low pH increases the unbalance ratio.

By analyzing these details, it can be seen that when using pure alternating current, the parameters intervening in the electrolytic colouring process cannot be acted on a freely, in the sense of applying them under the best conditions, due to the interdependence existing between them.

There is no doubt that satisfactory results in this sense have been obtained, but only on a laboratory level, with already existing patents. All these variable parameters, but especially the influence in the unbalance ratio of the surface to be coloured, give rise to a series of problems from an industrial point of view, facilitating to such colouring processes a series of difficulties of such a magnitude, due to the defects produced, that the surface dimensions of the piece to be coloured are not sometimes modified.

The object of the present invention is precisely that of autocontrolling the initial filtering effect of the anodic film, compensating the electrical variations which are produced therein during the colouring process, as well as the subsequent filtering effect which is modified as a result of the process itself.

This autocontrol is obtained by applying high voltage, autocontrolled and regulated by a circuit, which automatically compensates, at all times, the variations in the filtering effect of the anodic film.

To complement the description which will subsequently be made and to have a better understanding of the characteristics of the invention, a set of drawings is attached to the present specification, forming an integral part thereof, wherein the following is represented:

FIG. 1 corresponds to an electric model, representing the piece to be coloured.

Figure 4:
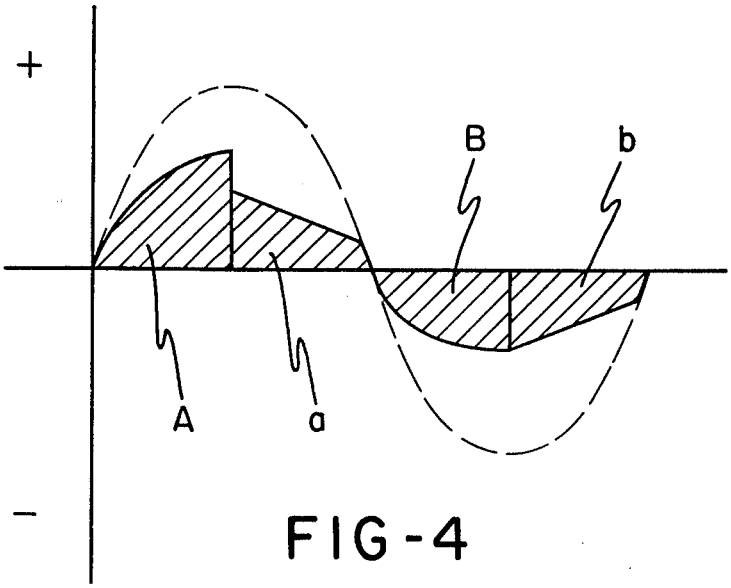

FIG. 4 refers to the same graph, when the symmetrical alternating current is controlled by thyristors.

Figure 5:
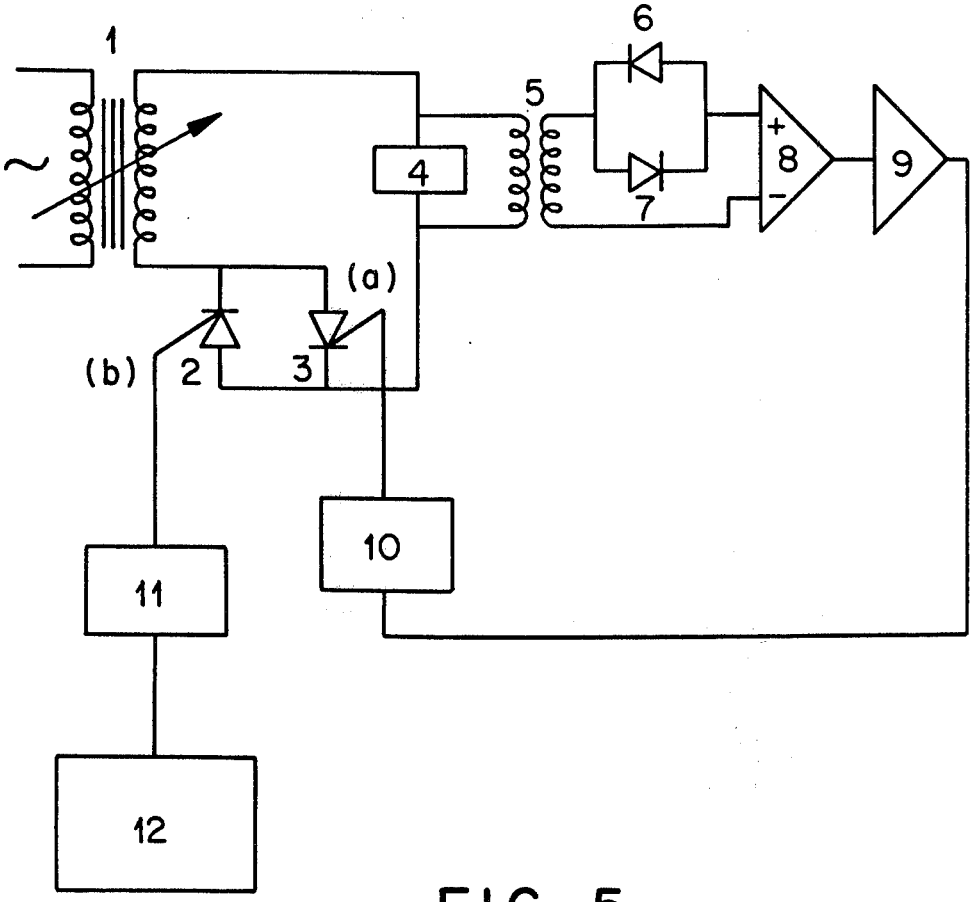

Finally FIG. 5 reflects, schematically, the circuit whereby the regulation and autocontrol of the voltage is obtained.

Figure 1:
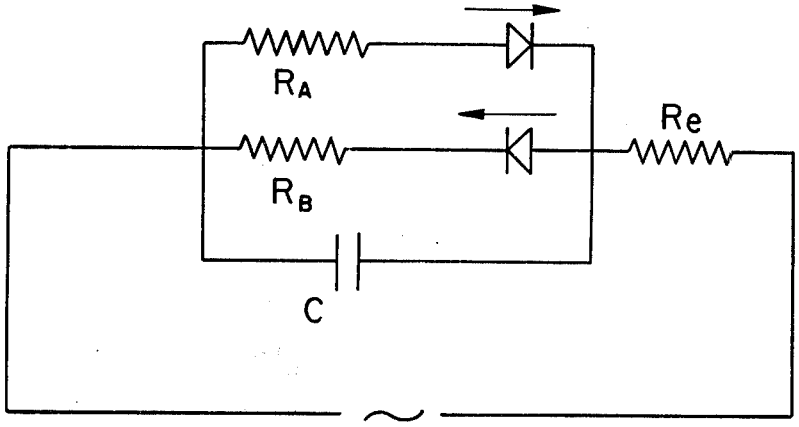
Figure 2:
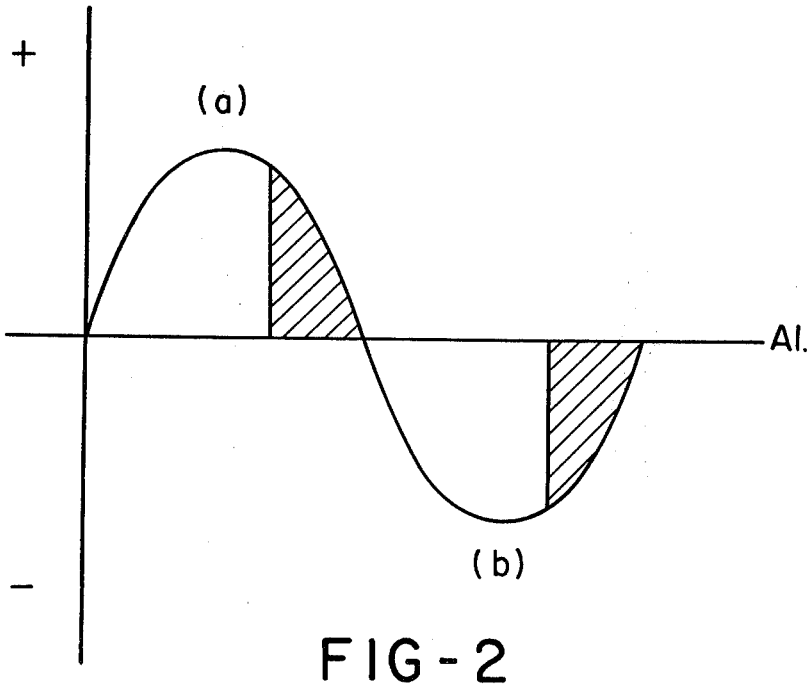
FIG. 2 illustrates a voltage-time graph of a symmetrical alternating current before being applied to the aluminium.
Figure 3:
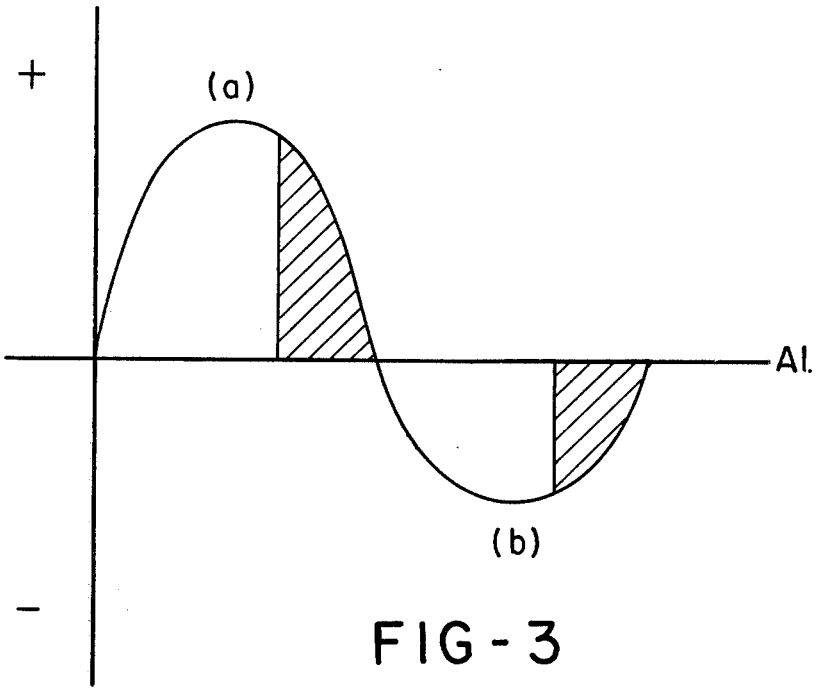
FIG. 3 represents the unbalance thereof, produced by the filtering effect.

The piece to be coloured can be represented according to the electrical model of FIG. 1, wherein the resistance R A is greater than R B, bearing in mind that the current circulates through R A when the aluminium is positive with respect to the counter-electrode and through R B when it is negative. In this way the semiconductor character of the anodic film is represented, C being the representation of the capacity of the film.

If a symmetrical aiternating current, regulated by thyristors, is applied it can be seen, as represented in FIG. 4, that the average voltage in the positive phase (A) is higher than that of the negative phase (B), thus observing furthermore that during the time in which the thyristors do not function, there are residual currents (a) and (b) due to the capacitance of the film which is increased, the larger the surface to be coloured.

The following is also complied with:

$$(V_A + V_B) > (V_B + V_b)$$

that is to say, the sum of the average values of the positive semi-cycle is larger than the sum of those of the negative.

This unbalance, just as the case of applying a pure alternating current, varies with the surface of the piece, with the applied voltage, with the pH, etc.

With the device, object of the invention, this unbalance is totally eliminated, the following being complied with at all times:

$$(V_A + V_B) = (V_B + V_b)$$

which permits the mentioned parameters to be played with in the most favourable manner, without depending on the voltage unbalance, since this does not exist.

In view of the aforementioned equation, it can be seen that one of the phases of the power transformer 1 is directly connected to the charge 4, while the other is so connected through two anti-parallel thyristors 2 and 3.

One of these thyristors 2, is controlled by a programming device or timer 12 through its corresponding trigger circuit 11, regulating the positive semi-cycle of the wave applied to the charge 4.

A second transformer 5, connected in parallel to the charge 4, feeds two anti-parallel diodes 6 and 7 through which an unbalance ratio detector 8 receives voltage which, after passing through an error amplifier 9, feeds the trigger circuit 10 of the thyristor 3, controlling and regulating the average value of the voltage applied to the charge, in its negative semi-cycle.

Thus, before commencing a colouring process, the control of the negative semi-wave of the voltage applied to the charge, corresponding to the deposition semi-cycle, is established by the programming device 12, effecting at all times the control and regulation of the positive semi-wave using the negative semi-wave as a reference, procuring that these are alike at all times. This is achieved by varying, in one direction or the other, the conduction angle of the thyristor 3.

By eliminating the unbalance between voltages in this way, charges having any surface can be coloured with a good penetration and a good fixing of the pigment, which is very important from the industrialization point of view of the process. There is no risk of weakening in the fixing of the anodic film to the metal base.

By way of example, it can be cited that employing a colouring bath containing Bismuth nitrate (2.5 gr/1), cobalt sulfate (12 gr/l) and sulfuric acid (40 gr/l). using a voltage of 14V at 22° C and a current density of 0.6 A/dm$^2$, a perfect bluish-gray colour is obtained.

Using copper sulfate and sulfuric acid, in suitable conditions and proportions, redish colours up to black are obtained.

I claim:

1. Apparatus for electrolytically coloring anodized aluminum, comprising:

a power transformer having a primary winding for connection with a source of alternating current and having a secondary winding which has one phase connected directly to the charge and its other phase connected to the charge through two anti-parallel thyristors;

first trigger means connected to one of said thyristors, said first trigger means being operative to trigger said one thyristor in accordance with a predetermined program;

second trigger means connected to the other thyristor and including means for detecting unbalance in the average values of the voltages applied to the charge in consecutive half cycles of the alternating current applied to the charge, whereby said second trigger means are operative to trigger said other thyristor in such a manner as to eliminate such unbalance

2. Apparatus we claimed in claim 1, wherein said means for detecting unbalance comprise a second transformer having a primary winding and a secondary winding, said primary winding being connected across the charge, a pair of anti-parallel diodes connected to be fed by the secondary winding, and an unbalance ratio detector connector to the anti-parallel diodes.

3. Apparatus as claimed in claim 2, wherein said one thyristor is poled to conduct when the aluminum is at a positive voltage with respect to the counter-electrode.

* * * * *